United States Patent [19]

Liem

[11] Patent Number: 4,460,491

[45] Date of Patent: Jul. 17, 1984

[54] PROCESS FOR PREPARING LOW SILICATE DETERGENT COMPOSITIONS

[75] Inventor: Seeng D. Liem, Rhoon, Netherlands

[73] Assignee: Lever Brothers Company, New York, N.Y.

[21] Appl. No.: 500,589

[22] Filed: Jun. 2, 1983

Related U.S. Application Data

[63] Continuation of Ser. No. 358,997, Mar. 17, 1982, abandoned.

[30] Foreign Application Priority Data

Mar. 23, 1981 [GB] United Kingdom ..... 8108969

[51] Int. Cl.[3] ..... C11D 3/04; C11D 11/02

[52] U.S. Cl. ..... 252/135; 252/174; 252/174.19; 252/174.25; 252/527; 252/546

[58] Field of Search ..... 252/135, 174, 174.19, 252/174.25, 527, 546

[56] References Cited

U.S. PATENT DOCUMENTS

| | | | |
|---|---|---|---|
| 3,328,314 | 6/1967 | Marquis | 252/383 |
| 3,428,690 | 1/1969 | Marquis | 252/137 |
| 3,962,149 | 6/1976 | Chirash et al. | 252/540 |
| 3,985,669 | 10/1976 | Krummel et al. | 252/135 |
| 3,998,762 | 12/1976 | Murata et al. | 252/551 |
| 4,000,094 | 12/1976 | Fleming et al. | 252/557 |
| 4,072,621 | 2/1978 | Rose | 252/140 |
| 4,140,650 | 2/1979 | Wilde | 252/135 |
| 4,180,485 | 12/1979 | Llenado | 252/532 |

FOREIGN PATENT DOCUMENTS 1365674 9/1974 United Kingdom .

*Primary Examiner*—John E. Kittle
*Assistant Examiner*—Hoa Van Le
*Attorney, Agent, or Firm*—Milton L. Honig; James J. Farrell

[57] ABSTRACT

The structure and hence the powder properties of spray-dried detergent powders are improved by the incorporation of a small amount of a succinate salt. In particular the invention is applicable to powders which are low in inherent structurants, especially to powders low in sodium silicate and in phosphate builder salts. Buccinic acid partially neutralized with sodium hydroxide is especially effective as a structuring aid.

5 Claims, 1 Drawing Figure

PROCESS FOR PREPARING LOW SILICATE DETERGENT COMPOSITIONS

Figure 1:
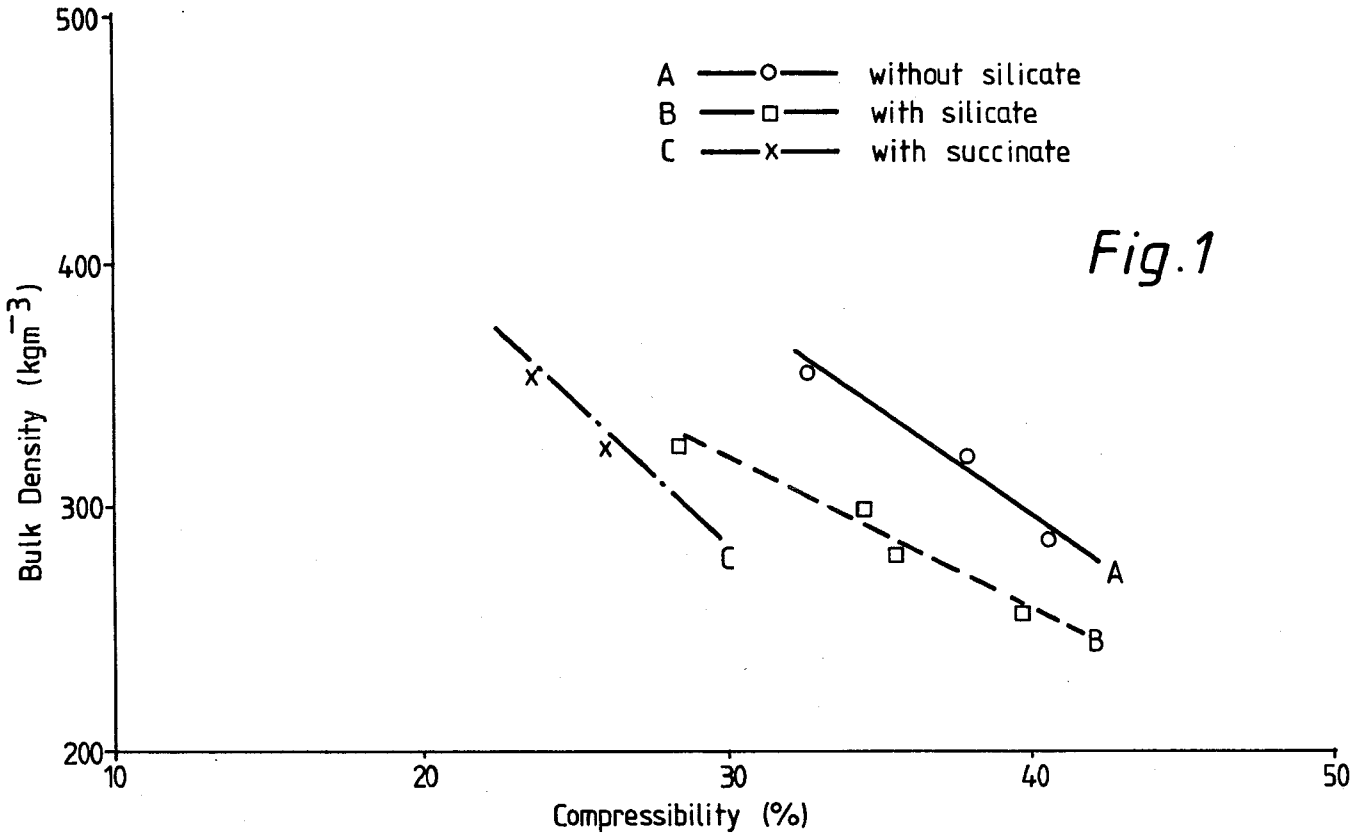

This is a continuation application of Ser. No. 358,997 filed Mar. 17, 1982, now abandoned.

This invention relates to detergent powders and to a process for preparing them. In particular, it relates to detergent powders containing only relatively small amounts of sodium silicate, or no sodium silicate at all.

It is now appreciated in the detergents art that sodium silicate has a pronounced effect in structuring of spray-dried detergent powders. However, inclusion of sodium silicate inevitably leads to a powder having a high pH which is preferably avoided if possible. There is also the difficulty that sodium silicate interacts adversely with the zeolite materials recently suggested as replacements for phosphate salts. As a consequence of these factors we believe that the sodium silicate content of the spray-dried powders of the future will contain lower amounts of sodium silicate than they do at present, and that this will lead to a powder which is inadequately structured.

We have now discovered that succinate salts can structure detergent powders and thus can perform the structurant function normally performed by sodium silicate.

Accordingly, the present invention provides a process for the preparation of a crisp, non-caking detergent powder which contains less than 4% by weight of sodium silicate, which process comprises the steps of (a) forming an aqueous slurry comprising nonionic surfactant, (b) conducting pressurised slurry to spray nozzles and (c) spray-drying the slurry to detergent powder, wherein the slurry comprises from 0.5 to 5% by weight, based on the spray-dried powder, of a water-soluble succinate salt.

In a second aspect of the invention there is provided a crisp, non-caking detergent powder containing a nonionic surfactant, and less than 4% by weight of sodium silicate comprising from 0.5 to 5% by weight of a water-soluble succinate salt.

U.S. Pat. No. 3,998,762 discloses detergent powders in which succinic acid or sodium succinate can be present, in combination with polyethylene glycol. However, in all of the powders disclosed in this patent specification the content of sodium silicate is at least 8% by weight and in some instances as high as 13%. This contrasts strongly with the field in which the present invention lies, namely that of detergent powders in which the content of sodium silicate is less than 4% by weight. We believe the contrast is a result of the fact that the behaviour of succinate in the two systems is different. In U.S. Pat. No. 3,998,762 the combination of polyethylene glycol with succinate (for example) is used to shift the phase boundaries in the aqueous slurry and inhibit the formation of a liquid crystal detergent active phase which would inevitably spray-dry to a sticky powder. In our invention on the other hand sodium succinate is believed to act as a film former and as a particle core.

U.S. Pat. No. 3,962,149 discloses spray-dried absorbent beads for absorbing nonionic surfactant. The beads are based essentially on sodium sulphate and are made in the conventional manner for spray-dried materials, that is to say, the components are made up into an aqueous slurry prior to spraying. In this particular specification it is proposed to use dibasic acids or salts thereof, such as sodium adipate (although sodium succinate is contemplated) in amounts of 2–30% of the bead, and it is believed that the function of these materials is to salt out sodium sulphate from solution in the slurry. Thus, in principle, any sodium or sulphate salt which is more soluble than sodium sulphate could be used. Were the sodium sulphate content of the bead not so high, the use of the dibasic acids or salts would not be necessary. The high level of sodium sulphate is necessary to get the required absorbency in a post-spray-on addition of nonionic surfactant, whereas in our invention the nonionic surfactant is incorporated into the powder via the slurry.

There are two ways in which the succinate salt can be incorporated in the slurry. First it can be incorporated prior to pressurising, for example by direct addition to a crutcher or, secondly, it may be incorporated into the pressurised slurry, for example into the pressurising pump itself or into the line conducting pressurised slurry to the spray nozzles. Whichever way is chosen, the amount of succinate which is incorporated is from 0.5% to 5% by weight based on the weight of the spray-dried powder, preferably 1 to 3% by weight.

It is believed that sodium succinate hexahydrate can play an important role in the securing of the technical effect of this invention, and consequently sodium is strongly preferred as the cation of the succinate ion. However, we believe that other water-soluble succinate salts may perform a similar role, albeit to a lesser extent.

If succinic acid partially neutralised with sodium hydroxide is used, we have discovered that this results in a spray-dried powder having particularly favourable powder properties. Although we do not wish to be limited by theory, we believe that this is due to the acid salt acting as a slurry hydrotrope as well as a powder structurant.

It will now be evident to the skilled man that our invention is concerned with one of the problems which arise when detergent powders are made which do not contain high proportions of sodium silicate. The problem is exacerbated when large amounts of sodium tripolyphosphate or other phosphate salts are absent and so the invention is particularly applicable to detergent powders which are low both in sodium silicate and in sodium tripolyphosphate. Of course, if no phosphate builder salt at all or only a small amount of such a salt is present, then the detergent performance of the powder will be unsatisfactory unless the deficiency of builder salt is made up with a non-phosphate builder compound. If no phosphate at all is present it is preferred that the builder salts present should be synthetic sodium aluminosilicate or sodium nitrilotriacetate or mixtures thereof. Where some phosphate salt is present, the builder may consist of binary or ternary mixtures of these compounds, or mixtures of the phosphate salt and some other builder such as sodium carboxymethyloxysuccinate.

Generally, the builder compound or compounds will be present in an amount of from 15–60% by weight. Non-phosphate builder compounds, when used in conjunction with phosphate salts, are preferably present in amounts of from 10–25% by weight, and when used by themselves, in amounts of from 20–40% by weight.

Detergent active compounds will, of course, be present in the detergent powders. Anionic detergent active compounds, including soaps, and nonionic surfactants as well as mixtures of these compounds can all be used. Typical amounts of detergent active compounds present in the powders are from 2 to 20% by weight when a nonionic surfactant is present alone, and from 2 to 25% by anionic surfactant and from 0.5 to 10% by weight of nonionic surfactant when a binary mixture is used.

A particularly preferred detergent active system is the so-called ternary mixture of anionic surfactant, nonionic surfactant and soap. Preferred amounts of the individual components of this mixture are from 2 to 15% by weight of anionic surfactant, from 0.5 to 7.5% by weight of nonionic surfactant and from 1 to 7.5% by weight of soap.

Examples of anionic surfactants which can be used are alkyl benzene sulphonates, particularly sodium alkyl benzene sulphonates having an average alkyl chain length of $C_{12}$; primary and secondary alcohol sulphates, particularly sodium $C_{12}$–$C_{15}$ primary alcohol sulphates, olefine sulphonates and alkane sulphonates.

The soaps which can be used are preferably sodium soaps derived from naturally-occurring fatty acids, preferably fatty acids from coconut oil, tallow or one of the oils high in unsaturated acids such as sunflower oil.

The nonionic surfactants which can be used are the primary and secondary alcohol ethoxylates, especially the $C_{12-15}$ primary and secondary alcohols ethoxylated with from 5 to 20 moles of ethylene oxide per mole of alcohol.

Other components of detergent powders which may optionally be present include lather controllers, antiredeposition agents, oxygen and chlorine bleaches, fabric softening agents, anti-ashing aids, slurry stabilisers, fluorescent agents, perfumes, germicides and colourants.

The process of the invention is particularly applicable to detergent powders which contain a reactive amide bleach precursor and a peroxy compound. The preferred reactive amide bleach precursor is tetraacetylethylenediamine (TAED) and preferred peroxy compounds are sodium perborate and sodium percarbonate. TAED may be present in an amount of 0.5 to 10% by weight and the peroxy compound in an amount of up to 45% by weight.

The invention is further illustrated by the following Example:

EXAMPLE

Three crutcher slurries of different formulation were made up and spray-dried to low phosphate powders of similar water content. The bulk densities of the powders were varied by varying the degree of aeration of the slurries, and the compressibilities of the resultant powders were measured by conventional means.

The formulations of the slurries is shown below and a plot of the bulk density against compressibility of the spray-dried powders is shown in FIG. 1.

| | Parts by weight | | |
|---|---|---|---|
| | A | B | C |
| Sodium alkylbenzene sulphonate | 6.5 | 6.5 | 6.5 |
| Primary alcohol ethoxylate | 3.0 | 3.0 | 3.0 |
| Sodium soap | 5.0 | 5.0 | 5.0 |
| Sodium tripolyphosphate | 18.0 | 18.0 | 18.0 |
| Sodium aluminosilicate (Zeolite) | 26.0 | 26.0 | 26.0 |
| Sodium silicate | Nil | 4.0 | Nil |
| Sodium sulphate | 6.0 | 4.0 | 6.0 |
| Sodium succinate | Nil | Nil | 3.0 |
| Minor components and water | 52.0 | 52.0 | 52.0 |

It can be seen from the FIGURE that plot C, which relates to the powder containing 3 parts (about 2% by weight of finished powder) of sodium succinate shows a powder having a substantially lower compressibility at equivalent bulk density than similar powders containing either no structurant at all, or containing sodium silicate as structurant.

What we claim is:

1. A process for the preparation of a crisp, free-flowing detergent powder which contains each in an effective amount for structuring the powder, a phosphate salt up to 6% by weight calculated as phosphorus, and up to 4% by weight sodium silicate, which process comprises the steps of (a) forming an aqueous crutcher slurry comprising from about 2% to 25% anionic and from about 3% to 20% nonionic surfactant, (b) conducting pressurized slurry to spray nozzles, and (c) spray-drying the slurry to detergent powder, wherein the slurry comprises from 1 to 5% by weight, based on the spray-dried powder, of a water-soluble succinate salt.

2. A process according to claim 1, wherein the water-soluble succinate salt is incorporated into the slurry prior to pressurizing.

3. A process according to claim 1, wherein the water-soluble succinate salt is incorporated into the pressurized slurry prior to spray-drying.

4. A process according to claim 1, wherein the water-soluble succinate salt comprises completely or partially neutralized sodium succinate.

5. A process according to claim 1 wherein the nonionic surfactant is present from about 3% to 10% by weight.

* * * * *